US009732638B2

(12) United States Patent
Yoon

(10) Patent No.: US 9,732,638 B2
(45) Date of Patent: Aug. 15, 2017

(54) VALVE LASH ADJUSTER FOR VEHICLES

(71) Applicant: Hyundai Motor Company, Seoul (KR)

(72) Inventor: Seock Joong Yoon, Hanam-Si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/929,282

(22) Filed: Oct. 31, 2015

(65) Prior Publication Data

US 2017/0016358 A1 Jan. 19, 2017

(30) Foreign Application Priority Data

Jul. 14, 2015 (KR) ..... 10-2015-0099718

(51) Int. Cl.

| | |
|---|---|
| ***F01L 1/18*** | (2006.01) |
| ***F01L 1/24*** | (2006.01) |
| *F01L 1/26* | (2006.01) |

(52) U.S. Cl.

CPC ..... *F01L 1/2416* (2013.01); *F01L 1/181* (2013.01); *F01L 1/26* (2013.01); *F01L 2810/02* (2013.01)

(58) Field of Classification Search

CPC ..... F01L 1/24; F01L 1/181; F01L 1/26; F01L 2810/02

USPC ..... 123/90.46

See application file for complete search history.

(56) References Cited

U.S. PATENT DOCUMENTS

| | | | | |
|---|---|---|---|---|
| 8,800,520 | B2 * | 8/2014 | D'Amore | F01L 1/24 123/90.52 |
| 2015/0122220 | A1 | 5/2015 | Cecur | |

FOREIGN PATENT DOCUMENTS

| | | | |
|---|---|---|---|
| JP | 63-97808 | A | 4/1988 |
| KR | 10-2004-0008348 | A | 1/2004 |
| KR | 10-2008-0046051 | A | 5/2008 |
| KR | 10-2009-0051490 | A | 5/2009 |

* cited by examiner

*Primary Examiner* — Zelalem Eshete

(74) *Attorney, Agent, or Firm* — Morgan Lewis & Bockius LLP

(57) ABSTRACT

A valve lash adjuster for vehicles may include a piston having a body and an opening/closing unit. The body has an open surface in a bottom and an oil passage extending from a rocker arm shaft to the open surface, such that oil flows through the oil passage. The opening/closing unit is disposed on the oil passage to selectively open the oil passage depending on a pressure of the oil. A cylinder accommodates the piston. The cylinder slides downward to form an oil chamber between an inner side surface thereof and the piston. The oil chamber contains the oil therein.

8 Claims, 8 Drawing Sheets

VALVE LASH ADJUSTER FOR VEHICLES

CROSS REFERENCE TO RELATED APPLICATION

The present application claims priority to Korean Patent Application No. 10-2015-0099718, filed Jul. 14, 2015, the entire contents of which is incorporated herein for all purposes by this reference.

BACKGROUND OF THE INVENTION

Field of the Invention

The present invention generally relates to a hydraulic valve lash adjuster for a vehicle. More particularly, the present invention relates to a valve lash adjuster for a diesel engine, such as a commercial diesel engine, having high power and a large engine displacement.

Description of Related Art

In general, an engine has a valve opening/closing mechanism enabling the operation of intake and exhaust valves using a crank shaft rotating following a piston motion. Such a valve opening/closing mechanism includes a cam shaft connected to the crank shaft by means of a belt to cooperate with the crank shaft, rocker arms rocking within a set range in response to the cam shaft, and intake and exhaust valves allowing the passage of mixture gas and exhaust gas through close contact with the rocker arms. In particular, since the heads of the intake and exhaust valves are exposed to the interior of a combustion chamber, the intake and exhaust valves expand with combustion heat applied thereto. For this, a hydraulic lash adjuster (HLA) adjusts the lash between the intake/exhaust valve and the rocker arm by considering the coefficient of expansion such that the lash between the intake/exhaust valve and the rocker arm is constantly set to "0." In a valve train system provided with such an HLA, the intake value or the exhaust valve opens and closes an intake port or an exhaust port while moving up and down in response to the knob of a cam pressing a rocker arm while rotating about the cam shaft. The HLA is disposed on one end of the rocker arm to adjust the valve lash while varying the height at which the rocker arm contacts the valve.

However, it is difficult to apply such an HLA to a commercial diesel engine having high power and a large engine displacement, due to the size of the HLA.

The information disclosed in the Background of the Invention section is only for the enhancement of understanding of the background of the invention, and should not be taken as an acknowledgment or as any form of suggestion that this information forms a prior art that would already be known to a person skilled in the art.

BRIEF SUMMARY

Various aspects of the present invention are directed to providing a lash adjuster using hydraulic pressure applicable to a commercial diesel engine having high power and a large engine displacement and able to remove noise, thereby improving product quality.

In an aspect of the present invention, there is provided a valve lash adjuster including: a piston including a body having an open surface in a bottom and an oil passage extending from a rocker arm shaft to the open surface, such that oil flows through the oil passage, and an opening/closing unit disposed on the oil passage to selectively open the oil passage depending on a pressure of the oil; and a cylinder accommodating the piston, wherein the cylinder slides downward to form an oil chamber between an inner side surface thereof and the piston, the oil chamber containing the oil therein.

The diameter of the oil passage of the body may increase in a downward direction, such that an opening/closing unit is provided at a point in which the diameter of the oil passage is increased.

The opening/closing unit may include an elastic member and a ball. The oil passage is opened when the ball presses the elastic member due to the pressure of the oil introduced to an interior of the body.

A retainer having an oil hole in a central portion may be disposed on the open surface of the body. The elastic member and the ball may be positioned above the retainer.

The opening/closing unit may include a check valve

In the piston accommodated within the cylinder, a lower portion of the piston in a lengthwise direction may be in close contact with the cylinder, and a gap may be formed between an upper portion of the piston in the lengthwise direction and the cylinder. A return member wound on an outer circumference of the piston may be disposed in the gap and may be supported by a lower portion of the piston, thereby pressing the cylinder upward.

The cylinder may have a leak hole in a position corresponding to the oil chamber. The oil leaks outwardly from the oil chamber through the leak hole when a load is applied to the cylinder from below, thereby removing an interior pressure of the oil chamber.

The cylinder may have a groove in a portion corresponding to the oil chamber, the groove having a leak hole. The oil leaks from the oil chamber through the leak hole to a space between a rocker arm and the cylinder when a load is applied to the cylinder from below, thereby removing an interior pressure of the oil chamber.

The bottom of the cylinder may extend downward. A socket ball formed of an elastic material may be coupled to the bottom of the cylinder.

The valve lash adjuster having the above-described structure is applicable to commercial diesel engines, the size of which is larger than that of passenger car engines, and is easily applicable to diesel engines having high power and a large engine displacement. In addition, since the valve lash is constantly adjusted to a set value using hydraulic pressure, noise and vibration qualities during the operation of engines are improved, and noise reduction and repair are simplified. Accordingly, product qualities are advantageously improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
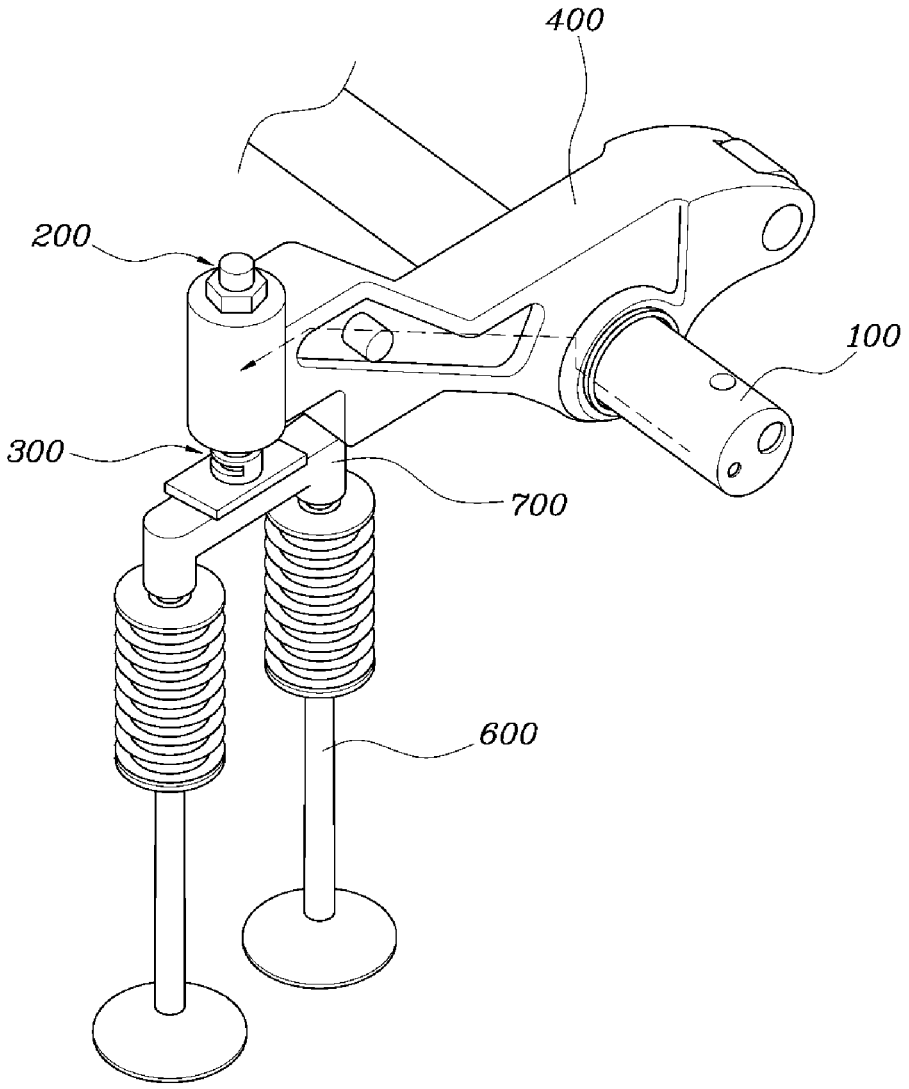
FIG. 1 is a perspective view illustrating an application of a valve lash adjuster according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in greater detail to a valve lash adjuster according to an exemplary embodiment of the present invention, an example of which is illustrated in the accompanying drawings. Wherever possible, the same reference numerals will be used throughout the drawings and the description to refer to the same or like parts.

Figure 2:
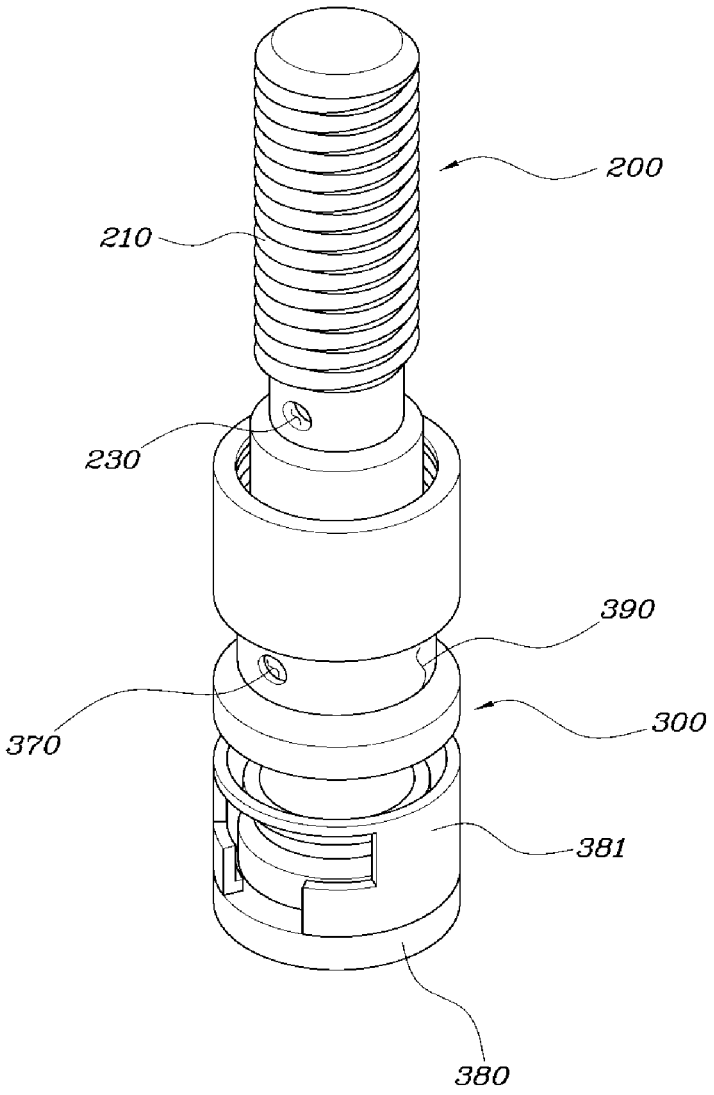
FIG. 2 is a perspective view illustrating the valve lash adjuster illustrated in FIG. 1.

FIG. 1 is a perspective view illustrating an application of a valve lash adjuster according to an exemplary embodiment of the present invention, FIG. 2 is a perspective view illustrating the valve lash adjuster illustrated in FIG. 1, FIGS. 3A, 3B, and 3C are exploded perspective and cross-sectional views illustrating the valve lash adjuster illustrated in FIG. 2, and FIGS. 4A, 4B, and 4C illustrate the operation of the valve lash adjuster illustrated in FIG. 2.

The valve lash adjuster according to the present exemplary embodiment includes a piston 200 and a cylinder 300. The piston 200 includes a body 210 having an open surface 211 in the bottom and an oil passage 230 extending from a rocker arm shaft 100 to the open surface 211, such that oil flows through the oil passage, and an opening/closing unit 250 disposed on the oil passage 230 to selectively open the oil passage depending on the pressure of the oil. The cylinder 300 accommodates the piston 200, and slides downward to form an oil chamber 310 between the inner side surface thereof and the piston 200, the oil chamber 310 containing the oil therein.

Figure 3A:
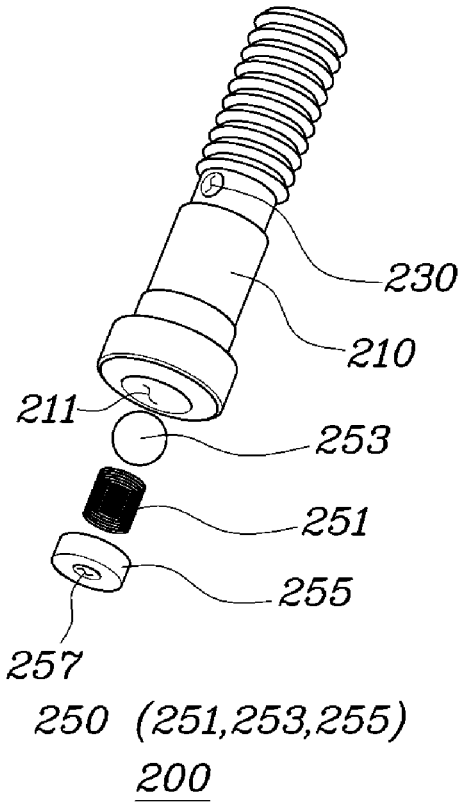
FIGS. 3A, 3B, and 3C are exploded perspective and cross-sectional views illustrating the valve lash adjuster illustrated in FIG. 2.
Figure 3B:
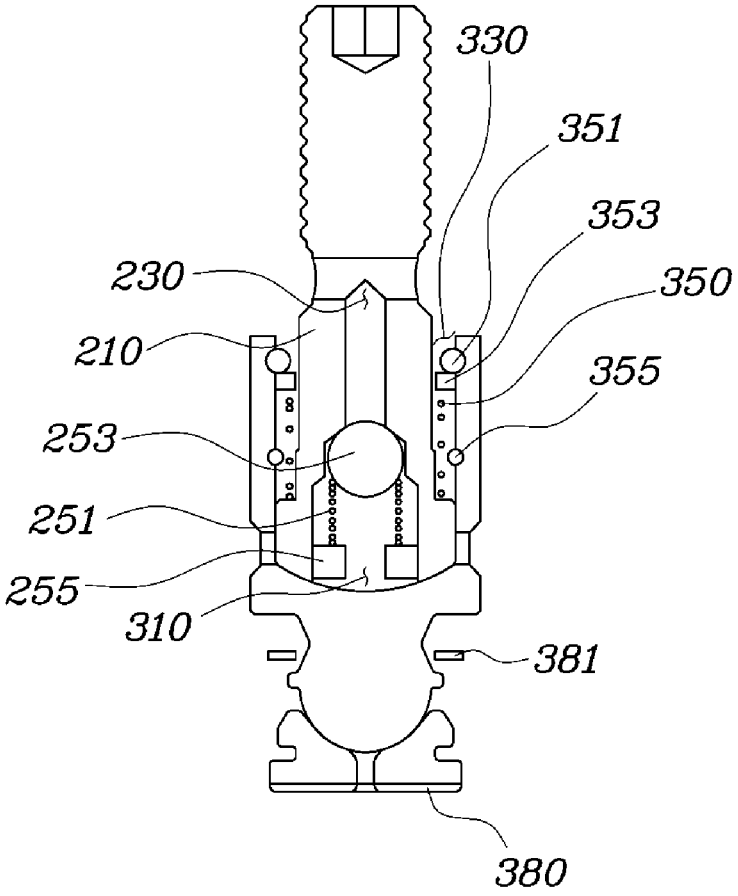

The valve lash adjuster according to the present exemplary embodiment will be described in greater detail with reference to FIG. 3A, FIG. 3B and FIG. 3C. First, FIG. 3A is an exploded perspective view of the piston 200. As illustrated in FIG. 3A, the piston 200 includes the body 210 having defined therein the oil passage 230 and the opening/closing unit 250 disposed within (fitted into) the body 210. In particular, the diameter of the oil passage 230 of the body 210 increases in the downward direction, and the opening/closing unit 250 is provided at a point in which the diameter of the oil passage 230 is increased.

The opening/closing unit 250 includes an elastic member 251 and a ball 253. When the ball 253 presses the elastic member 251 due to the pressure of oil introduced to the interior of the body 210, the ball 253 is forced downward to open the oil passage 230. When the pressure of oil is equal to the pressure applied to the interior of the piston 200, the ball 253 is forced upward by the elastic force of the elastic member 251, thereby closing the oil passage 230. It is preferable that a retainer 255 having an oil hole 257 in the central portion be disposed on an open surface 211 of the body 210, and that the elastic member 251 and the ball 253 be positioned above the retainer 255. The opening/closing unit 250 may be implemented as a check valve.

Figure 3C:
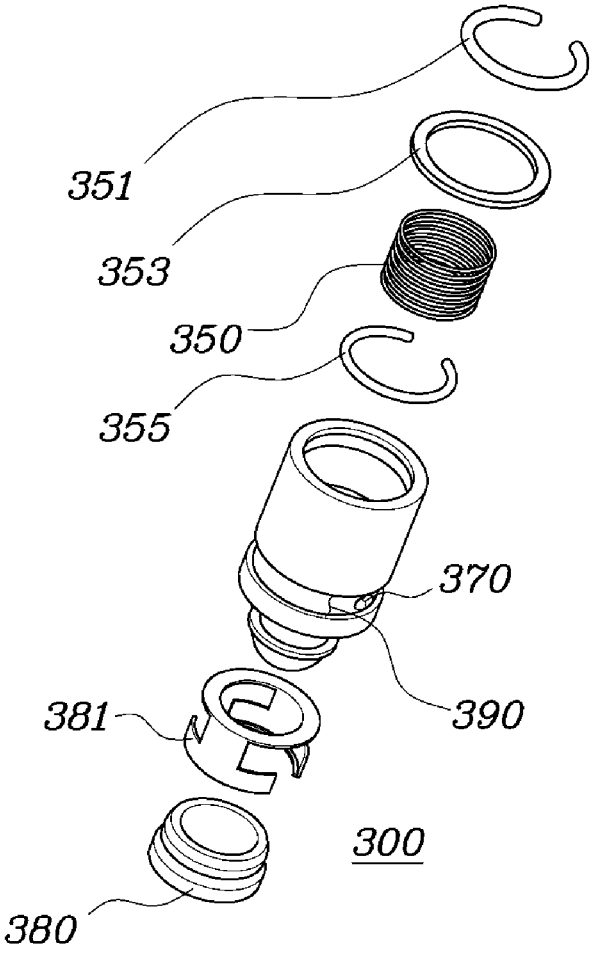

In addition, FIG. 3C is an exploded perspective view of the cylinder 300. The cylinder 300 has a cylindrical shape accommodating the piston 200. The bottom of the cylinder 300 extends downward, and a socket ball 380 and a socket retainer 381 formed of an elastic material are coupled to the bottom of the cylinder 300. Thus, the socket ball 380 absorbs an impact applied to or noise occurring from a valve 600 or a valve bridge 700 that would otherwise be transferred to the cylinder 300 or the piston 200 of the valve lash adjuster, thereby reducing noise and vibration.

The bottom of the piston 200 is in close contact with the cylinder 300. When the oil introduced from the rocker arm shaft 100 flows downward along the oil passage 230 of the body 210 of the piston 200, the oil chamber 310 is formed between the piston 200 and the interior of the cylinder 300 due to the pressure of the oil. The oil introduced to the oil passage 230 of the piston 200 is contained in the oil chamber 310. The pressure of the oil causes the cylinder 300 to slide downward, thereby increasing the volume of the oil chamber 310. In this manner, the oil continues to be contained within the oil chamber 310 until the pressure of the oil is equal to the internal pressure of the oil chamber 310.

The piston 200 is accommodated within the cylinder 300 such that the lower portion of the piston 200 in the lengthwise direction is in close contact with the cylinder 300 and a gap 330 is formed between the upper portion thereof and the cylinder 300. A return member 350 wound on the outer circumference of the piston 200 is disposed in the gap 330. The return member 350 is supported by the lower portion of the piston 200, thereby pressing the cylinder 300 upward. The return member 350 may be implemented as a coil spring that applies force upward and downward. It is preferable that a snap ring 351, a retainer 353, and the like that prevent the return member 350 from being dislodged are added to the upper and lower portions of the return member 350, and a snap ring 355 and the like that restricts the downward displacement of the cylinder 300 are provided on the lower portion of the return member 350.

When the internal pressure of the oil chamber 310 is equal to the pressure of the oil, the cylinder 300 slides downward, thereby increasing the displacement. To move the cylinder 300 upward for lash adjustment requires removal of the pressure of the oil chamber 310. Thus, a leak hole 370 is formed in the cylinder 300 as a device for removing the pressure of the oil chamber 310. The leak hole 370 is formed in the position of the side portion of the cylinder 300 corresponding to the oil chamber 310. When a load from the valve 600 is applied the cylinder 300 from below, the oil leaks outwardly from the oil chamber 310 through the leak hole 370, thereby removing the interior pressure of the oil chamber 310.

More specifically, the cylinder 300 has a groove 390 in the portion corresponding to the oil chamber 310, recessed inward along the circumference of the cylinder 300. The leak hole 370 is formed in the groove 390. When the load from the valve 600 is applied to the cylinder 300 from below, the oil leaks from the oil chamber 310 through the leak hole 370 to the space between the rocker arm 400 and the cylinder 300, thereby removing the internal pressure of the oil chamber 310.

The operation of the valve lash adjuster according to the present exemplary embodiment will be described with reference to the above-described features and FIG. 4A, FIG. 4B and FIG. 4C.

Figure 4A:
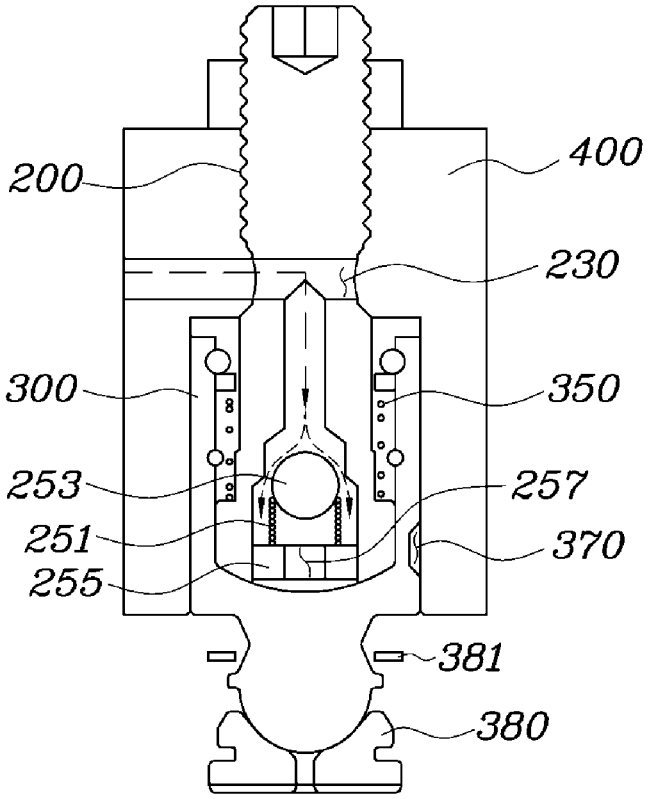
FIGS. 4A, 4B, and 4C illustrate the operation of the valve lash adjuster illustrated in FIG. 2.

FIG. 4A illustrates a position after the engine is started in which oil is introduced into the interior of the valve lash adjuster from the rocker arm shaft 100. In this case, the oil is supplied in a pressure ranging from 3 to 4 atm. Consequently, the pressure of oil forces the ball 253 downward, overcoming the elastic force of the elastic member 251, so that the oil passage 230 is opened. The oil is gradually supplied into the oil passage 230, pressing the cylinder 300 to slide downward. This consequently increases the volume of the oil chamber 310.

Figure 4B:
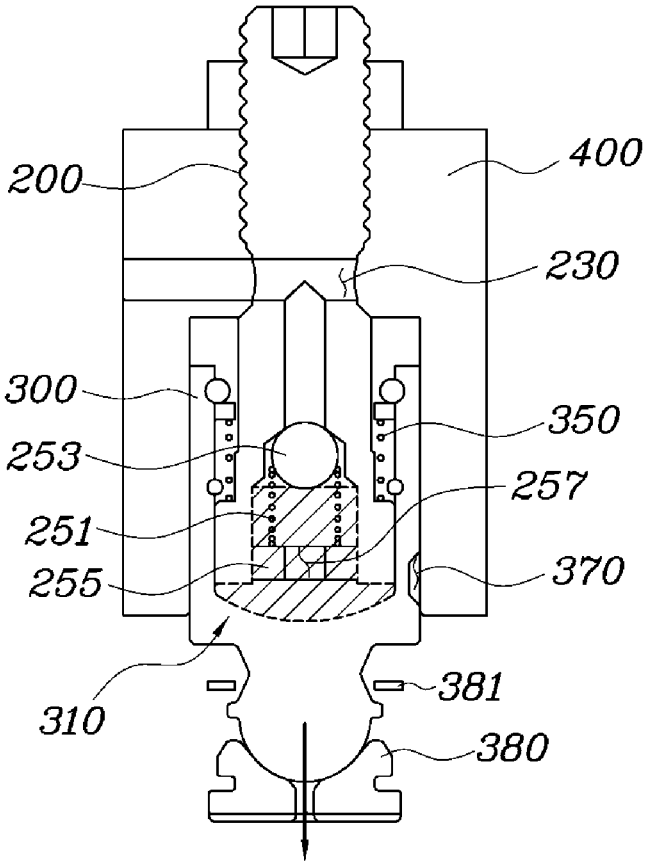
Figure 4C:
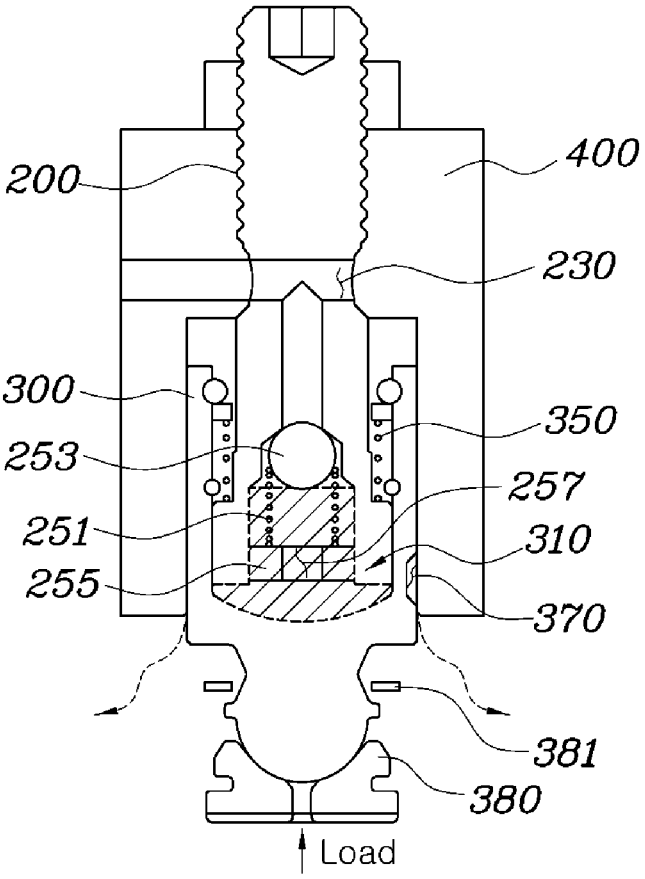

A variation in the displacement of the cylinder 300 can be recognized from FIG. 4B. When the interior pressure of the oil chamber 310 becomes equal to the pressure at which the oil is supplied in response to the continuous supply of the oil, the elasticity of the elastic member 251 drives the ball 253 upward, thereby closing the oil passage 230, so that the oil is no further introduced. When the load from the valve 600 is applied to the cylinder 300 from below due to a difference in the gap during the operation of the valve 600, the oil leaks from the groove 390 and the leak hole 370 of the cylinder 300 leaks to the space between the rocker arm 400 and the cylinder 300, as illustrated in FIG. 4C. The return member 350 drives the cylinder 300 to slide upward.

In addition, through the above-described operation, the interior pressure of the oil chamber 310 becomes lower than that of the oil supplied. The pressure of the oil forces the ball 253 downward, overcoming the elastic force of the elastic member, so that the oil flows into the piston again, causing the cylinder 300 to slide downward. In this manner, the lash of the valve 600 is adjusted by repeating the operations illustrated in FIG. 4A, FIG. 4B and FIG. 4C.

The valve lash adjuster according to the present exemplary embodiment is applicable to commercial diesel engines, the size of which is larger than that of passenger car engines, and is easily applicable to diesel engines having high power and a large engine displacement. In addition, since the valve lash is constantly adjusted to a set value using hydraulic pressure, noise and vibration qualities during the operation of engines are improved, and noise reduction and repair become easy. Accordingly, product qualities are advantageously improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve lash adjuster comprising:

a piston comprising a body having an open surface in a bottom and an oil passage extending from a rocker arm shaft to the open surface, such that oil flows through the oil passage, and an opening/closing unit disposed on the oil passage to selectively open the oil passage depending on a pressure of the oil; and a cylinder accommodating the piston, wherein the cylinder slides downward to form an oil chamber between an inner side surface thereof and the piston, the oil chamber containing the oil therein, wherein the cylinder has a leak hole in a position corresponding to the oil chamber, whereby the oil leaks outwardly from the oil chamber through the leak hole when a load is applied to the cylinder from below, thereby removing an interior pressure of the oil chamber.

2. The valve lash adjuster according to claim 1, wherein a diameter of the oil passage of the body increases in a downward direction, such that the opening/closing unit is provided at a point in which the diameter of the oil passage is increased.

3. The valve lash adjuster according to claim 1, wherein the opening/closing unit comprises an elastic member and a ball, wherein the oil passage is opened when the ball presses the elastic member due to the pressure of the oil introduced to an interior of the body.

4. The valve lash adjuster according to claim 3, wherein a retainer having an oil hole in a central portion thereof is disposed on the open surface of the body, and the elastic member and the ball are positioned above the retainer.

5. The valve lash adjuster according to claim 1, wherein the opening/closing unit comprises a check valve.

6. The valve lash adjuster according to claim 1, wherein, in the piston accommodated within the cylinder, a lower portion of the piston in a lengthwise direction is in close contact with the cylinder, a gap is formed between an upper portion of the piston in the lengthwise direction and the cylinder, and a return member wound on an outer circumference of the piston is disposed in the gap and is supported by a lower portion of the piston, thereby pressing the cylinder upward.

7. The valve lash adjuster according to claim 1, wherein the cylinder has a groove in a portion corresponding to the oil chamber, the groove having the leak hole.

8. The valve lash adjuster according to claim 1, wherein a bottom of the cylinder extends downward, and a socket ball formed of an elastic material is coupled to the bottom of the cylinder.

* * * * *